US005496457A

United States Patent [19]

Antelman et al.

[11] Patent Number: 5,496,457

[45] Date of Patent: Mar. 5, 1996

[54] COMPACT PLATING CONSOLE

[75] Inventors: Perry W. Antelman, Providence; Edward S. Eliasz, Cumberland; Scott Factor, East Providence, all of R.I.

[73] Assignee: Tivian Industries, Ltd., East Providence, R.I.

[21] Appl. No.: 330,435

[22] Filed: Oct. 28, 1994

[51] Int. Cl.[6] ..... C25D 17/02

[52] U.S. Cl. ..... 204/238; 204/239; 204/270

[58] Field of Search ..... 204/240, 270, 204/275–278, 269, 238, 239

[56] References Cited

U.S. PATENT DOCUMENTS 1,664,482 4/1928 Pfanhauser ..... 204/278

4,171,255 10/1979 Tuznik et al. ..... 204/270 X 4,592,819 6/1986 Suzuki et al. ..... 204/278 X 4,781,806 11/1988 Tenace et al. ..... 204/240 X 5,338,248 8/1994 Sumrack ..... 204/270 X

*Primary Examiner*—Donald R. Valentine

*Attorney, Agent, or Firm*—Salter & Michaelson

[57] ABSTRACT

An electroplating console for small production runs having the plating capability of four or less finishes. The console has a compact design occupying no more than 22 square feet and comprises closed loop water purification that eliminates the need for sewer line connections.

1 Claim, 3 Drawing Sheets

COMPACT PLATING CONSOLE

BACKGROUND OF THE INVENTION

The present invention is a novel compact self contained electroplating unit which is geared for ecological electroplating and closed loop water purification. Accordingly, the invention is a novel design for a console of said unit. Said console is based on the subject matter of another invention of coinventor Antelman, for which U.S. patent application Ser. No. 08/330,436, filed Oct. 28, 1994, now abandoned, entitled "Ecological Sludgeless Plating System". This other application relates to a closed loop plating system which collects all waste metals on mixed bed ion exchangers incorporating precious metal exchangers. The spent resin is periodically removed and sent to the precious metal refiner where the non-precious metals become incorporated into precious metal alloy bars.

After having successfully demonstrated the utility of Antelman's aforesaid invention for large scale operations, it was then decided to address the plating problems of manufacturers of jewelry, emblems, buckles, findings and electronic hardware who wanted to plate sample lines, small parts or small production runs in small capacity tanks not exceeding five gallons. With that objective in mind, the instant invention was conceived. One major consideration in designing such a unit is space. The goal was to design a compact plating console which would measure less than 22 square feet, excluding plumbing, that would require no sewer line connections, and that would have the plating capability of four finishes.

Such a unit has been successfully developed. Furthermore, applicants have also successfully developed consoles on a smaller scale for those desiring only two or three finishes.

OBJECTS OF THE INVENTION

It is therefore an object of the present invention to provide means of plating four distinct finishes from five-gallon plating baths within a single unit not exceeding 22 square feet.

It is a further object of the present invention to accomplish the first object while endowing the unit with support capacity to achieve said finishes with individual cascade rinse and dragout tanks for each finish.

It is a further object of said invention to provide within the same space constrictions the capacity for a heated electrocleaner with its own cascade rinse.

It is still a further object of said invention to provide within the aforementioned space constrictions all of the heretofore mentioned four finishes, support dragout rinses, cascade rinses and electrocleaning functions in such a manner that all waste water is purified and recirculated in a closed loop with no sewer drain connections required.

Other objects and features of the present invention will become apparent to those skilled in the art when the present invention is considered in view of the accompanying description. It should, of course, be recognized that the accompanying description illustrates preferred embodiments of the present invention and are not intended as a means of defining the limits and scope of the present invention.

SUMMARY OF THE INVENTION

The invention comprises a plurality of five-gallon plating tanks, preferably four, constructed of heat resistant plastic, e.g. polypropylene, arranged side by side within the console, the overall dimensions of the console being less than 22 square feet. Said console actually measures 6.2 feet in length and 3.5 feet in width, which equals a total of 21.7 square feet. The console's back is provided with five rectifiers whose controls and panels protrude above said tanks. The fifth rectifier controls the supply of electricity to another five-gallon tank on the extreme left of the console which contains an electrocleaner. In the front of the electrocleaning tank is a five-gallon cascade rinse tank. To the right of said tank is an acid rinse tank of five-gallon capacity, and in front of it is a five-gallon cascade rinse. The electrocleaner and the acid rinse provide full capacity cleaning capability for any of the subsequent finishes. Each finishing tank has directly in front of it a 2.5 gallon dragout rinse and in front of each dragout rinse is a 2.5 gallon cascade rinse. Accordingly, one can begin to the left of the console to do the cleaning and then move right to deposit four subsequent finishes. Each plating tank is provided with heater, pump and filter. The extreme right of the console has a holding tank which holds and recirculates purified water.

In a preferred embodiment of this invention, zinc diecastings are electrocleaned, rinsed, acid activated and rinsed. Said castings are then plated with a copper strike, dragout rinsed and cascade rinsed. Thereafter the castings are ready to accept a heavy copper electroplate in the second finishing tank. After this operation, the parts are dragout rinsed, cascade rinsed and electroplated in the third finishing tank with nickel. The parts are subsequently dragout rinsed from nickel, cascade rinsed and electroplated with gold in the fourth finishing tank. The parts are then rinsed both ways.

Thus, the jewelry manufacturer who has a new line to electroplate but has no capacity in his regular mass production plating to handle samples, will find it to his advantage to have such a unit, for said manufacturer does not have to wait for outside contractors to perform the service. Furthermore, said manufacturer does not require any regulatory permits to connect his plating console, since it is self contained and recycles fresh water. Thus there is no need for either a costly plumbing in-line water hookup or drains, nor permission to connect a drain.

DESCRIPTION OF THE PREFERRED EMBODIMENT

Figure 1:
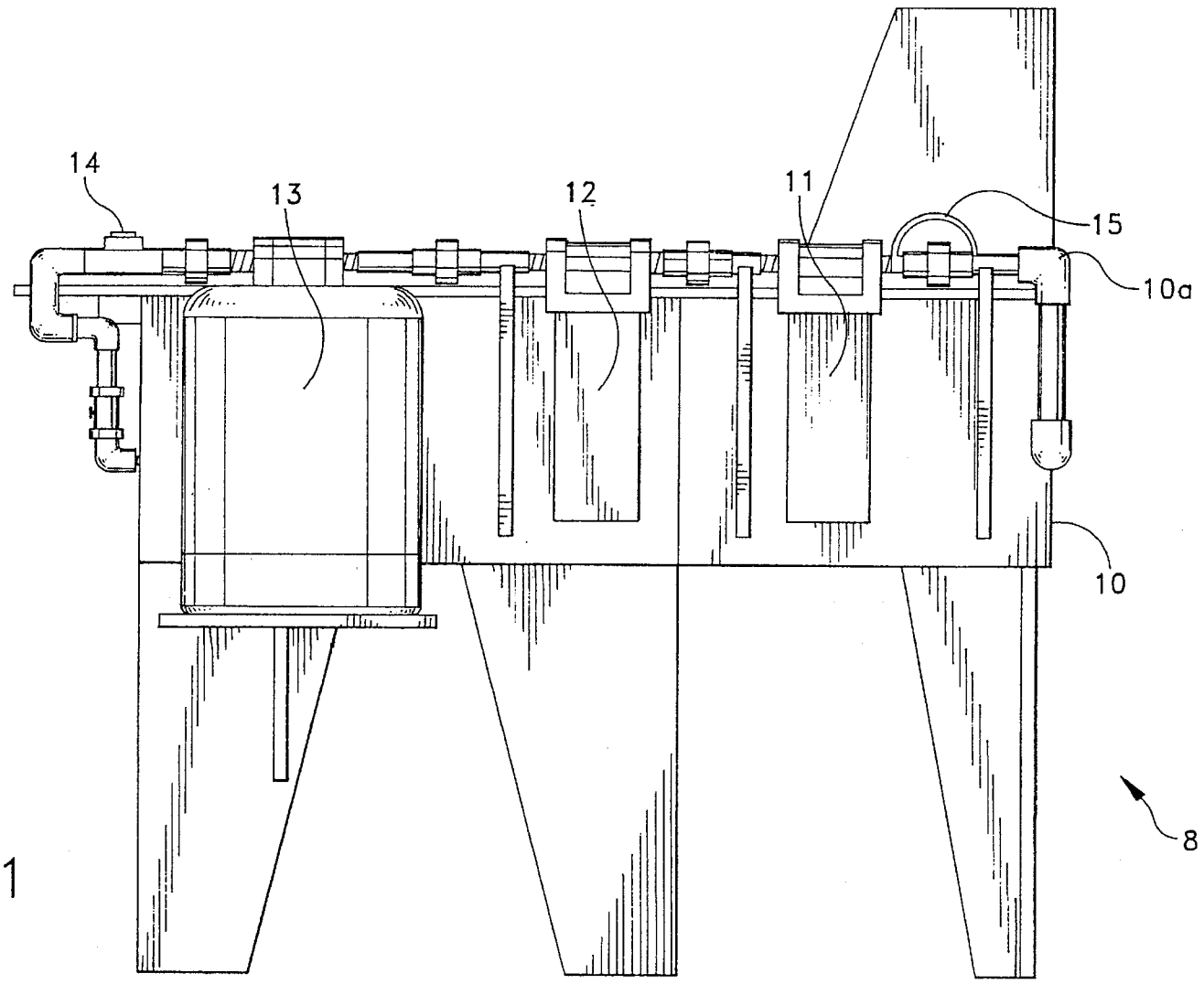
FIG. 1 is a side elevational view of the right hand end of a console embodying our invention.

Referring to FIG. 1 of the drawings, there is shown a side view of the right hand end of the console shown generally at 8. The console front to back, within its 3.5 feet of plating tank width, provides ten gallons of capacity front to back in each compartment. FIG. 1 also shows the outside detail of the engineered recirculation, purification system which recirculates pure contaminated water to the console units. As water leaves the tanks through pipe **10*a*, it circulates to particle filter 11 and back through pipe 10*a* to an organic filtering system containing activated carbon 12 which removes all organic contaminants. It again enters pipe 10*a* traveling from the back of the console towards the front to a large holding tank 13**, which contains the aforementioned mixed ion exchange resins heretofore described.

As the fresh water is monitored back again into the console system from tank 13 through pipe 10*a*, there is a conductivity monitor light 14 which assures the user that pure deionized water is going back into the console system. All six sections of the console, i.e. electrocleaner, acid rinse and four finishing tanks, are vented at the back so that any fumes resulting from any of the attendant operations can be immediately removed. The main ventilation suction unit 15, which is optional, produces a negative pressure gradient.

Figure 2:
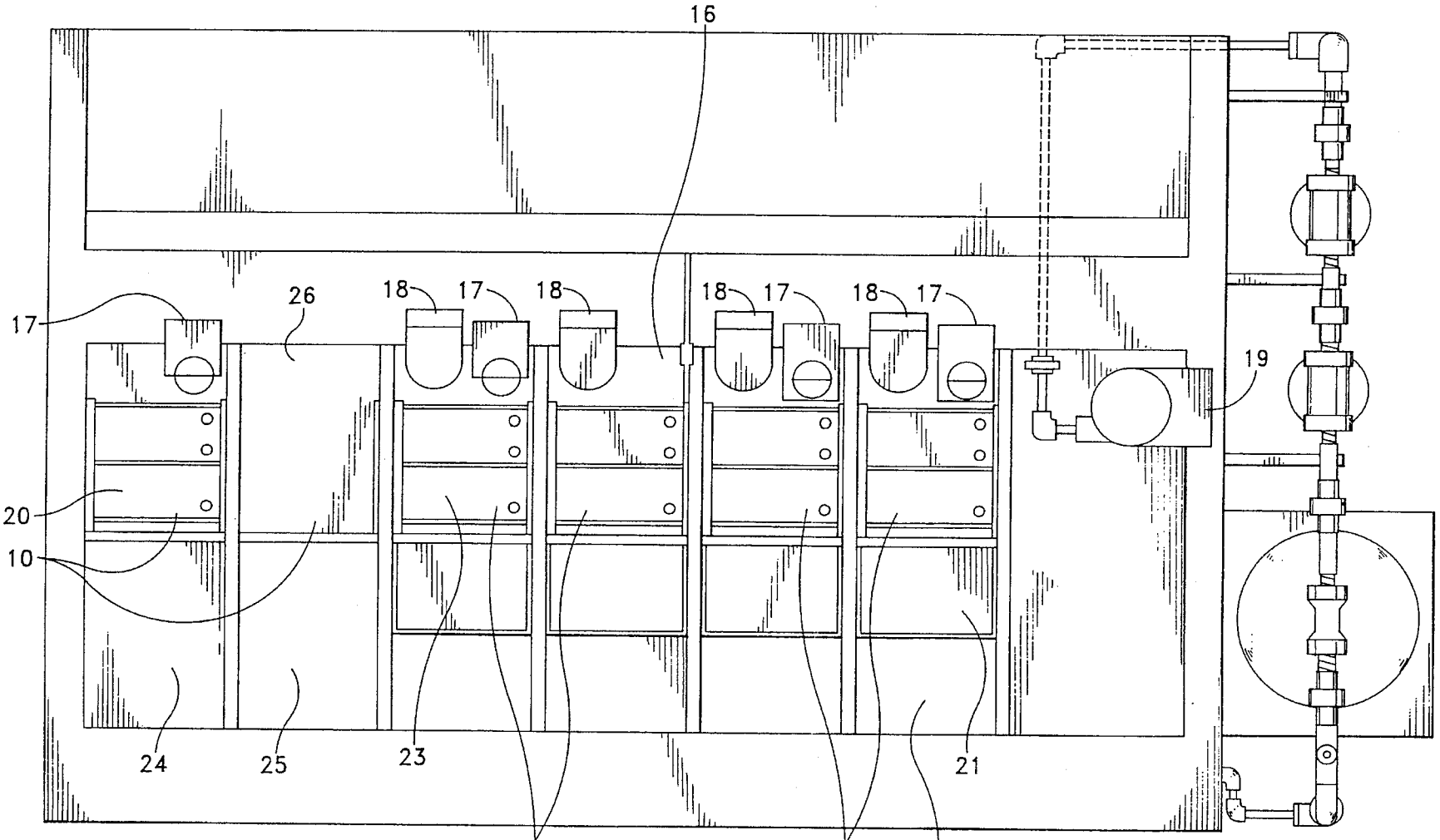
FIG. 2 is a top plan view thereof.

FIG. 2 is a top view of the console. There the ten gallon front to back capacity tanks 10 are shown subdivided horizontally into six units. Four of these units, which are used in finishing and which go from right to left, are each divided into five-gallon sections for finishing 23 and dragout rinse 21 and the final cascade rinse 22. Each of the finishing tanks are provided with heaters, each having constant temperature controls 17. They also each have filter pumps 18. Air agitation is maintained in each tank by means of a sparger line 16 at the median of the four finishing tanks 23. Shown here in FIG. 2 is the water circulation pump 19, which provides the positive pressure for interfacing with pipe 10*a* shown in FIG. 1. The extreme left tank 20 contains the electrocleaner. It has a heater 17. The front section of said electrocleaner has a large cascade rinse 24 with five-gallon capacity. To its right is a similar cascade rinse 25 which washes goods after they have left the five-gallon acid rinse 26.

Figure 3:
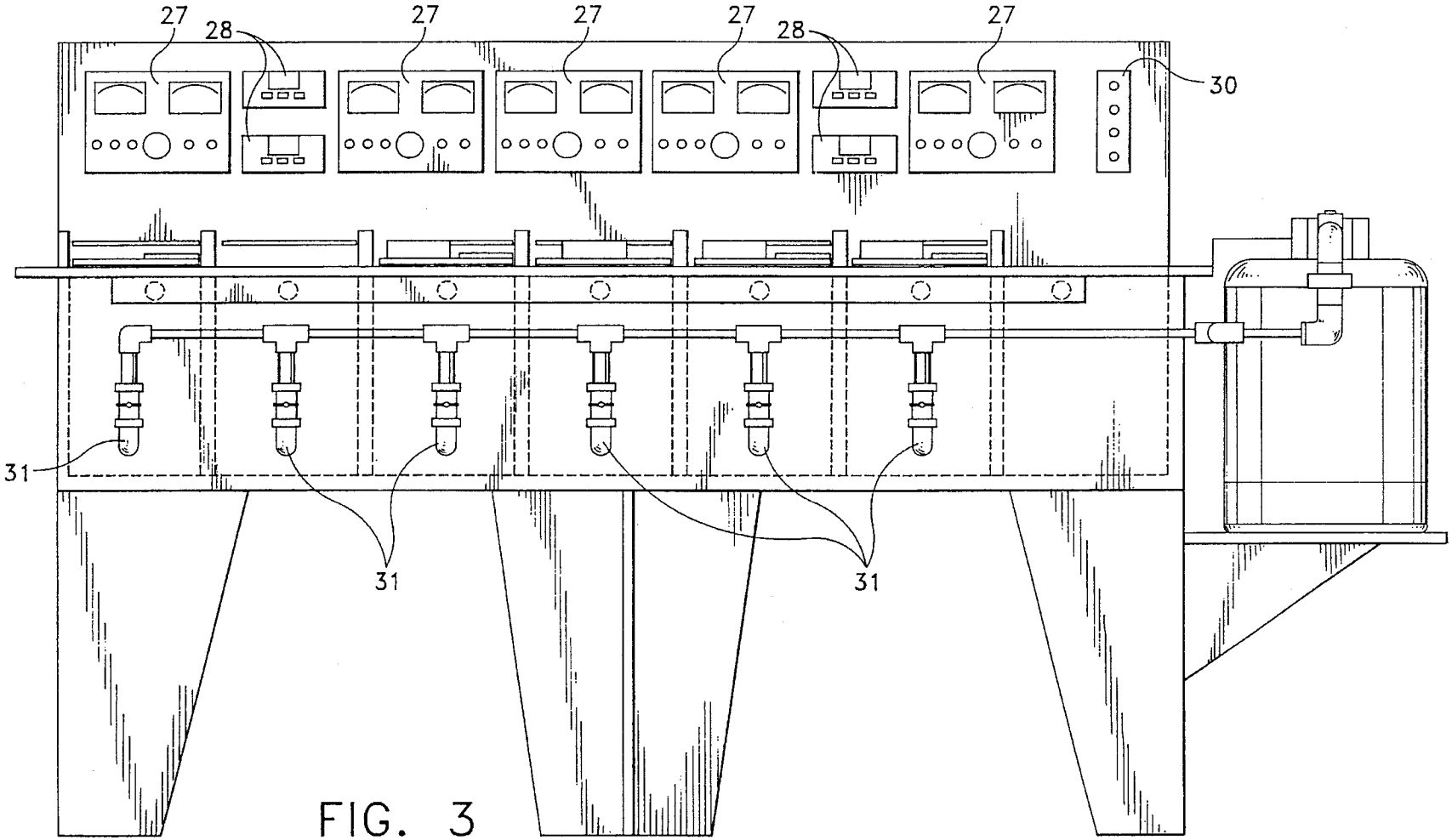
FIG. 3 is a front elevational view thereof.

FIG. 3 shows a front elevation of the console looking to the back. The back panel P of the console, which runs its entire length, is provided with five rectifiers 27, and four temperature controls 28. Fume ventilators 29 are provided over each of the six sections as is depicted, for example, over the second section. Switches 30 for the four pumps in the finishing tanks are at the extreme right of the controls on the console. Finally, the six deionized water return control valves 31 are shown which enable the return of fresh water to reach the six sections of the console.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A compact electroplating console whose total active operating space does not exceed 22 square feet, said console comprising:

a) four five-gallon finishing tanks for receiving electrodeposited finishes, each of said finishing tanks having dragout and cascade rinse tanks connected thereto;

b) one five-gallon electrocleaning tank;

c) one five-gallon acid activator tank;

d) said electrocleaning and acid activator tanks each having a cascade rinse tank connected thereto;

e) said finishing, electrocleaning and acid activator tanks being mounted in side by side relation on said console;

f) constant temperature control means operatively connected to each of said finishing tanks;

g) rectifiers operatively connected to said finishing and electrocleaning tanks;

h) a mixed bed ion exchange holding tank mounted on said console, said holding tank being in communication with said finishing, electrocleaning and acid activator tanks;

i) valve means for controlling the flow of deionized water from said holding tank to said finishing, electrocleaning and acid activator tanks, and for recirculating the water from said tanks back to said holding tank;

j) means for controlling operation of said constant temperature control means, said rectifier, and said valve means;

k) A particle filter and an organic contaminant filter through which water from said tanks flows as said water returns to said holding tank; and l) Negative pressure gradient fume removal means connected to said finishing, electrocleaning and acid activator tanks for effecting fume removal therefrom.

* * * * *